United States Patent [19]

Meyer et al.

[11] Patent Number: 4,817,202

[45] Date of Patent: Mar. 28, 1989

[54] PROCESS AND APPARATUS FOR CONTROL AND MONITORING OF INSTALLATION BY TRANSMISSION OF INFORMATION AND OF COMMANDS BY OPTICAL MEANS

[75] Inventors: Jacques Meyer, Sartrouville; Jean M. Bouchet, Ville D'Avray; Jean P. Lande, Saclas, all of France

[73] Assignee: Framatome, Courbevoie, France

[21] Appl. No.: 875,916

[22] Filed: Jun. 19, 1986

[30] Foreign Application Priority Data

Jun. 19, 1985 [FR] France ..... 85 09335
Jul. 17, 1985 [FR] France ..... 85 10966

[51] Int. Cl.[4] ..... H04B 9/00; H04J 1/14

[52] U.S. Cl. ..... 455/603; 370/3; 455/612

[58] Field of Search ..... 455/603, 605, 612, 610; 370/1, 3

[56] References Cited

U.S. PATENT DOCUMENTS 3,845,294 10/1974 Indig et al. ..... 370/3
4,367,040 1/1983 Goto ..... 356/44
4,459,591 7/1984 Haubner et al. ..... 455/603

FOREIGN PATENT DOCUMENTS 54363 6/1982 European Pat. Off. ..... 455/605
2479981 4/1980 France .
2530393 1/1984 France .
2530392 1/1984 France .
2536545 5/1984 France .
2543768 10/1984 France .
1540907 2/1979 United Kingdom .

OTHER PUBLICATIONS

Alessi et al.-"A Negative Ion Sputter"-Nuclear Instruments and Methods-North Holland Pub. Co.-147, No. 2 (Dec. 1977), pp. 305-312.

Ayers et al.-Solid State Optical Transmission System-IBM Tech. Discl. Bulletin, vol. 12, #8, Jan. 1970, pp. 1150, 1151.

*Primary Examiner*—Michael A. Masinick
*Assistant Examiner*—Andrew J. Telesz, Jr.
*Attorney, Agent, or Firm*—Pollock, Vande Sande & Priddy

[57] ABSTRACT

The industrial installation comprises an active zone (III) with which there are associated means for measurement and for command and a control position (I) separated from the active zone. Means for measurement, for control and for command (15) located in the active zone are supplied with luminous radiations, from the control position, through an optical fibre (8) joining the active zone to the control position. Radiation having a broad spectral band is emitted in the fiber (8) from the control position (I) and then divided in order to obtain unitary radiations for supplying each of the means (15). The invention applies to nuclear reactors.

3 Claims, 5 Drawing Sheets

I
II
III
A
B
C
P1
P2
P3
P4
1
2
3a
3b
3c
3d
4a
4b
4c
4d
5a
5b
5c
5d
6
8
10
12
15
16
17
18
19
20
21
22
23

I
II
III
A
B
C
$C_1$
$C_2$
6'
10'
12
12
16
16
28
$P_1$
$P_2$
$P_3$
17
18
19
29
30
31
32
34
40
41
42
43
44
44
COMMAND EQUIPMENT
INTERFACE
MOTOR
OPTICAL MODULATOR

PROCESS AND APPARATUS FOR CONTROL AND MONITORING OF INSTALLATION BY TRANSMISSION OF INFORMATION AND OF COMMANDS BY OPTICAL MEANS

FIELD OF THE INVENTION

The invention relates to a process and an apparatus for control and for supervision of an industrial installation by transmission of information and commands by optical means.

BACKGROUND OF THE INVENTION

Industrial installations are known, which comprise an active part in which the industrial process is carried out and a control and supervision position separate from the zone including the active part of the installation are known in the art. The active part of the industrial installation includes means for measurement, control and command which are associated with its various components in order to permit control and supervision thereof. These means for measurement, control and command are extremely numerous, and must be connected with the control position by an assembly of conductors permitting transmission of the information and the orders providing for the command and the control of the installation in operation.

In a complex industrial installation, the means for measurement, control and command are capable of providing for the acquisition, transmission and/or reception of information and of orders of very widely differing types. These items of information relate to parameters of the industrial process, such as temperature, pressure or throughout level, and likewise to positions of components such as gates or valves. In addition to the items of information relating to the industrial process, the system may transmit items of information originating from test materials or providing for communications between the operators or any other type of information.

In the case of certain industrial installations, the conditions prevailing within the zone including the active part of the installation make the acquisition, the transmission and/or the reception of the information or orders within this active zone extremely difficult.

This is so in the case of nuclear power stations including a pressurized water nuclear reactor, in which it is necessary to effect measurements within the building of the reactor, which is not accessible during the operation of this reactor. The requirement for a very high degree of reliability and for a high degree of accuracy on the part of the apparatus for acquisition and for transmission of data necessitates the operation, quite frequently, of inspections of the means for acquisition and for transmission of these data. It is likewise necessary to protect the same against the influence of the environment in which the industrial process is carried out.

In prior art systems, the data are acquired, transmitted and utilized in the form of electrical signals passing through conductors joining the control position to the active zone of the industrial installation. In the case where intense magnetic fields are developed within this active zone, it is necessary to isolate the conductors from these magnetic fields and, for example, to use screened cables for the passage of the conductors. This is so, for example, in metallurgical or steel making installations.

In all these cases, it is necessary to isolate the conductors in an efficient manner and to effect earthing of the components for protection of the cables and of their mechanical support. In certain installations, it is necessary to use coaxial cables involving high costs for the low level electrical signals and the digital data at high throughout. It is also necessary to provide devices for galvanic decoupling between the places where the information is taken.

In certain installations, it may be extremely dangerous to convey electric currents, even of low intensity, in the vicinity of substances or media which are inflammable or explosive. This is so, for example, in the case of petroleum or petro-chemical installations or installations for the processing of natural gas. These risks are still further increased in circumstances in which sources of current are necessary in the vicinity of the means for measurement, for command or for control within the active part of the installation.

On the other hand, in the case of complex installations including a large number of means for measurement and for control, and therefore a large number of links with the control position, it is necessary to reduce to the greatest possible extent the volume and the cost of the linking conductors used; it is likewise necessary to make provision for possibilities for increasing the number of links, in the event of a modification of the industrial process or of an improvement in this process necessitating a larger number of measurements or of inspections. In order to achieve these results, it has been proposed to use electronic multiplexers/demultiplexers, which permit at the same time a reduction of the number of links which are necessary between the active part of the installation and the control position and an increase of the number of points of measurement, of control or of command without increasing the number of links. However, such electronic multiplexers/demultiplexers are very costly and require local sources of supply, within the active part of the installation.

On the other hand, devices are known for telecommunication by optical means which permit the joining, by optical fibers, of the emitting positions to the receiving positions, with multiplexing and demultiplexing of the modulated optical signals circulating within the optical fibers. However, the use of such devices has not become general in circumstances in which it is desired to join a control position of an industrial installation to the active zone of such installation. The difficulty is, in fact, that such a device for teletransmission by optical fibers requires the establishment of luminous sources in the vicinity of the points of emission of the information and thus in the vicinity of the measurement sensors, within the active zone of the industrial installation which is being controlled and supervised. These luminous sources require, for the establishment thereof, the presence of electrical sources in the vicinity of the active components of the industrial installation.

It has been proposed, in U.S. Pat. No. 4,367,040, to supply temperature measurement sensors placed in different positions in a rotor by means of fixed optical sources independent of the rotor. A broad spectral band radiation is formed by coupling of these sources and directed into an optical device borne by the rotor ; that device carries out the division of the board spectral band radiation in order to obtain unitary radiations of different wavelengths which are each sent to a temperature sensor. No material link is present between the fixed optical sources and the rotor, and the luminous radiation having a broad spectral band is emitted in the direction of the rotor axis to be received by the optical device borne by the rotor. The length of the propagation path of the luminous radiation for reaching the rotor can be maintained at a very low value.

In the case of an industrial installation, the active zone of which must be separated by a great distance, from the zone where the luminous radiations are generated, such a method cannot be used.

SUMMARY OF THE INVENTION

The object of the invention is thus to propose a process for the control and for the supervision of an industrial installation by transmission of information and of orders by optical means, the industrial installation comprising an active part with which means for measurement, for control and for command are associated and a control and supervision position separated by a large distance, from the zone in which the active part is situated, at least one optical fiber providing for the transmission of the information and of the orders between the active part of the installation and the control position. The process permits the derivation of maximum benefit from the advantages of an optical transmission, with the avoidance of any presence of sources of electric current within the active part of the installation, and with the provision of a perfectly identified optical radiation associated with each one of the means for measurement, for control or for command.

In order to achieve this object, the means for measurement, for control and for command situated in the active part of the installation are supplied with unitary luminous radiations, from the supervision position and through the optical fiber, by directing in this optical fiber, from the supervision position, a luminous radiation having a broad spectral band and by dividing this luminous radiation in order to obtain unitary radiations for supplying each of the means for measurement, control and command with a luminous radiation.

The invention likewise relates to a device for control and for supervision of an industrial installation permitting the transmission of information and of orders by optical means.

BRIEF DESCRIPTION OF THE DRAWINGS

In order to render the invention readily comprehensible, a description will now be given, by way of non-limiting example, of several modes of implementation of the process according to the invention used for the control and the supervision of a nuclear power station including a pressurized water reactor.

In FIG. 1, imaginary vertical lines 1 divide the space in which the apparatus is situated into three successive zones I, II and III.

Figure 1:
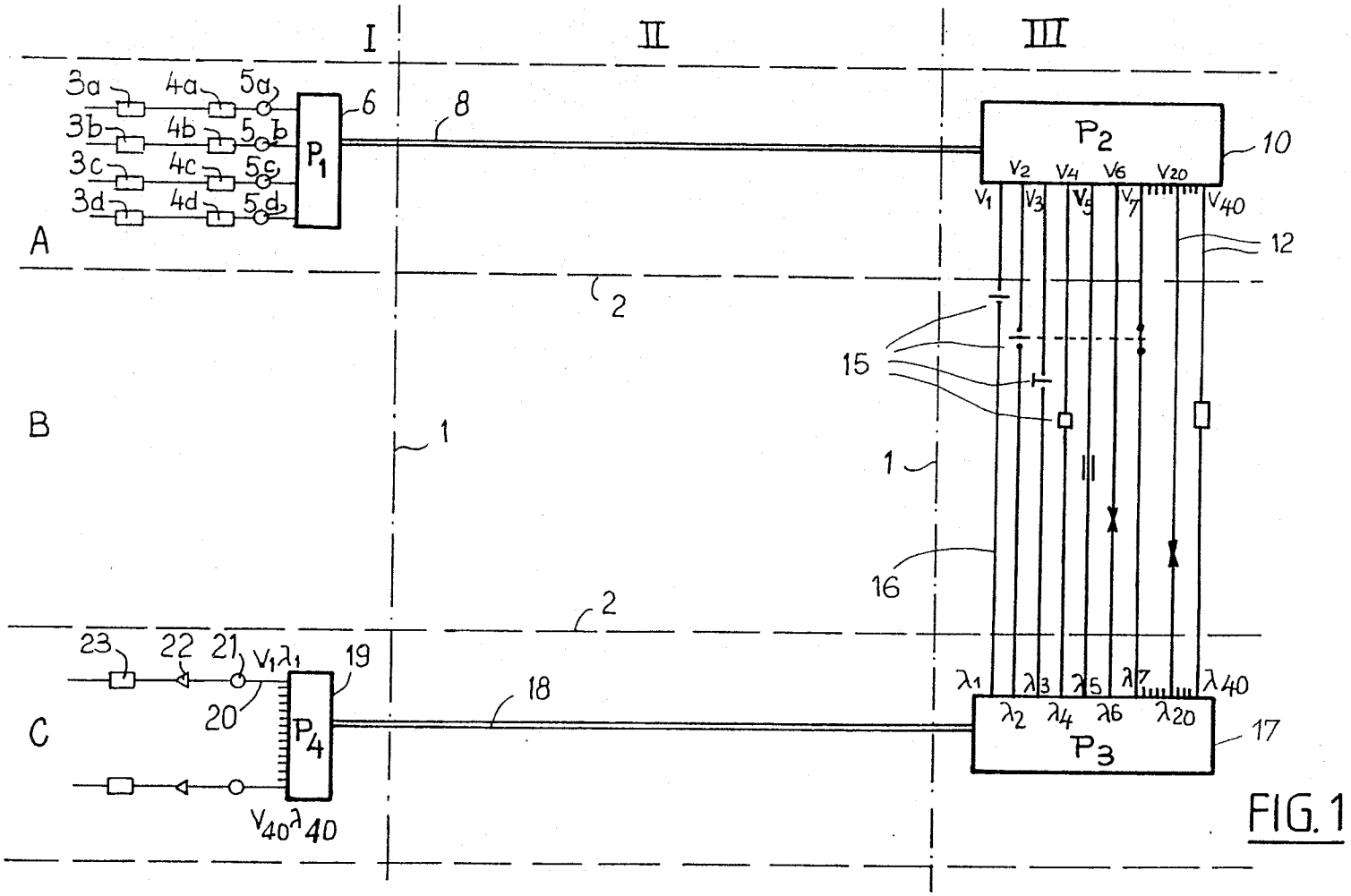
FIG. 1 is a schematic representation of the entire apparatus permitting the transmission of information by optical means between the control room and the active part of the power station including the building of the reactor, where the apparatus makes use of polychromators.

The zone 1 corresponds to the control room of the nuclear power station, the zone III corresponds to the active zone of the nuclear reactor including the building of the reactor, and the zone II represents the space existing between the control room and the reactor building.

The space occupied by the optical apparatus represented has likewise been divided into three zones A, B and C, by imaginary horizontal lines 2 intersecting the vertical lines 1.

The zone A corresponds to the function of the generation of optical sources within the apparatus; and zone B corresponds to the modulation of the luminous radiation within the sensors for acquisition of the measured parameters of the power station; the zone C corresponds to the transmission to the control room of modulated luminous signals representing the measurements made within the active zone.

The functional part of the apparatus situated in the zone A comprises, within the control room, for the generation of the optical sources, four oscillators 3*a*, 3*b*, 3*c* and 3*d* and four regulators 4*a*, 4*b*, 4*c* and 4*d* ensuring the stability of the four sources 5*a*, 5*b*, 5*c* and 5*d* thus established. The assembly for generating the sources includes furthermore within the control room 1 a polychromator 6 which ensures the coupling of the optical sources 5 and the emission of a radiation having a broad spectral band within an optical fiber 8.

The optical sources 5 are, in fact, generated by the devices 3 and 4 in such a manner as to obtain by coupling of these sources a radiation having a broad spectral band emitted at the output of the polychromator 6 into the optical fiber 8.

The polychromator 6 may be of the type comprising multidielelectrics, as described in French Patent No. 2.530.393 or networkds as described in French Pats. Nos. 2.479.981 and 2.543,768.

According to the invention, the radiation having a broad spectral band is conveyed by the optical fiber 8, through the intermediate zone II,between the control room and the active part of the nuclear power station. The output end of the optical fiber 8 leads to the input of a polychromator 10, which may likewise be of the type comprising multidielectrics or comprising networks.

In the case of a polychromator 10 comprising multidielectrics and constituted by an assembly of spherical mirrors, certain ones of which are provided with dielectric layers, the end of the fiber 8 terminates in the vicinity of the focus of one of the mirrors. The mirrors provided with dielectric layers are selective at given wavelengths, and each mirror is designed to separate by transmission or selection a band of small spectral width. The ray specific to each mirror converge to the focus of this mirror, at which the input end of an optical fiber 12 is located. The fibers 12 constitute the output fibers of the polychromator 10 situated within the active zone of the installation, for example within the reactor building of the nuclear power station. Division by wavelength of the radiation transmitted by the fiber 8 thus leads to the creation of an assembly of unitary radiations of low spectral width, centered about a characteristic wavelength, which are collected by optical fiber 12, actually within the active zone of the power station.

In polychromators comprising networks, the end of the emission optical fiber 8 is located in the vicinity of the focus of a concave mirror associated with a plane diffraction network. The light rays originating from the optical fiber 8 are thus reflected by the concave mirror in a direction parallel to the axis of the mirror towards the diffraction network. The light rays are then sent towards the concave mirror, which focuses them at specific points in its focal plane, as a function of their wavelength. The optical fibers 12 at the output of the polychromator have their input end located in the focal plane of the mirror, at positions corresponding to the wavelengths which they are designed to transmit.

Forty optical fibers 12 permitting the collection of unitary radiations of small spectral width centered about a wavelength which is fully determined are disposed at the output of the polychromator 10.

The part of the apparatus situated within the functional zone A corresponding to the generation of the sources thus permits the location actually within the active zone of the installation of a large number of luminous radiations which are entirely distinct by virture of their wavelength, without having to use optical sources placed within the active zone. In this manner, any requirement to establish optical sources within the active zone of the installation, based on means necessitating electrical sources, is avoided.

Each one of the optical fibers 12 is connected to a particular sensor 15 within the active zone of the installation, each sensor 15 being associated with a component of the industrial installation in order to effect a measurement or a control. The sensors 15 may be of different types and may constitute, for example, all-or-nothing or all-or-little optical sensors permitting the determination of the position or the presence of a component of the installation, displacement sensors operating on the principle of the variation of amplitude of luminous flux of different wavelengths, command elements operating by an optical signal, direct optical sensors operating by modification of the characteristics of the optical fiber itself under the influence of various external parameters (temperature, pressure) or indeed electro-optical modulation sensors operating in accordance with the principle of the variation of index under the action of an electric field.

Certain links provided by the fibers 12 are utilized for the permanent control of the apparatus for optical transmission.

At the output of the sensors 15, the modulated light rays are transmitted by optical fibers 16 extending the fibers 12 beyond the sensors, to a polychromator 17 which permits collection of the various rays at the output of the sensors. An optical fiber 18 is situated at the output of the polychromator 17 in order to collect the various modulated light rays received by this polychromator 17. The optical fiber 18 thus ensures the simultaneous and independent transmission of the light rays representing the state of the forty sensors 15. The polychromator 17 thus effects the multiplexing of the light information originating from the sensors 15. The fiber 18 joins the polychromator 17 situated within the active zone to a polychromator 19 located within the control room. The polychromator 19 effects the demultiplexing of the light information which is collected by optical fibers 20 permitting transmission of the various rays reflecting the measures and information to optoelectronic converters 21 permitting conversion thereof into electrical signals. These electrical signals are amplified by virture of amplifiers 22 and are processed in preliminary processing modules 23. It is possible to proceed, within these modules, with preliminary processing operations such as the comparison of the signals with predetermined thresholds, the comparison of the signals among themselves or the monitoring of their development over time.

Certain modes are used, as has been indicated above, to carry out permanent monitoring of the state of the essential components of the transmission apparatus. Thus, it is possible to reserve one mode, for example, for monitoring the state of the source 5*a* and of its supply circuit 31, 4*a* as well as the state of the polychromators 6, 10, 17 and 19 with regard to their zone corresponding to the frequency band of the source 5*a*.

Other modes may be reserved for permanently supervising the state of the other sources and of the corresponding parts of the polychromators.

In place of the polychromator 6 intended to collect the rays from the four optical sources 5, it is possible to use a coupler constituted by juxtaposition of an optical fiber having a large diameter with four optical fibers coming from the sources 5*a*, 5*b*, 5*c* and 5*d*. In the same way ,it is possible to use, in place of the polychromator 10, a decoupler comprising an input channel and a plurality of output channels. Contrary to what is the case at the output of a polychromator such as 10 (FIG. 1), the unitary light rays at the output of the decoupler have the same spectrum of wavelengths as the radiation guided by the fiber 8, i.e., a spectrum corresponding to the sources 5.

Such couplers/decouplers are described, for example, in French Pat. No. 2.536.545.

Use is made, in combination with three couplers, of devices for multiplexing and demultiplexing, for the transmission of the data, produced in the form of polychromators 17 and 19, as described with reference to FIG. 1. The modulated light rays originating from the sensors 15 are transmitted to the polychromator 17 by fibers 16. Each fiber 16 originating from a particular sensor 18 is connected to the polychromator 17, at a well defined place on the latter. This permits the transmission to the fiber 18, at the output of the polychromator 17, of a collection of rays of different wavelengths each corresponding to a modulated ray emerging from a specific sensor. Only a proportion of the light radiation emerging from each sensor, corresponding to wavelengths close to a specific wavelength, is transmitted by the polychromator 17 to the fiber 18, as a function of the siting of the fiber 16 on the polychromator. The rays emerging from the various sensors may be specifically identified in this manner.

Figure 2:
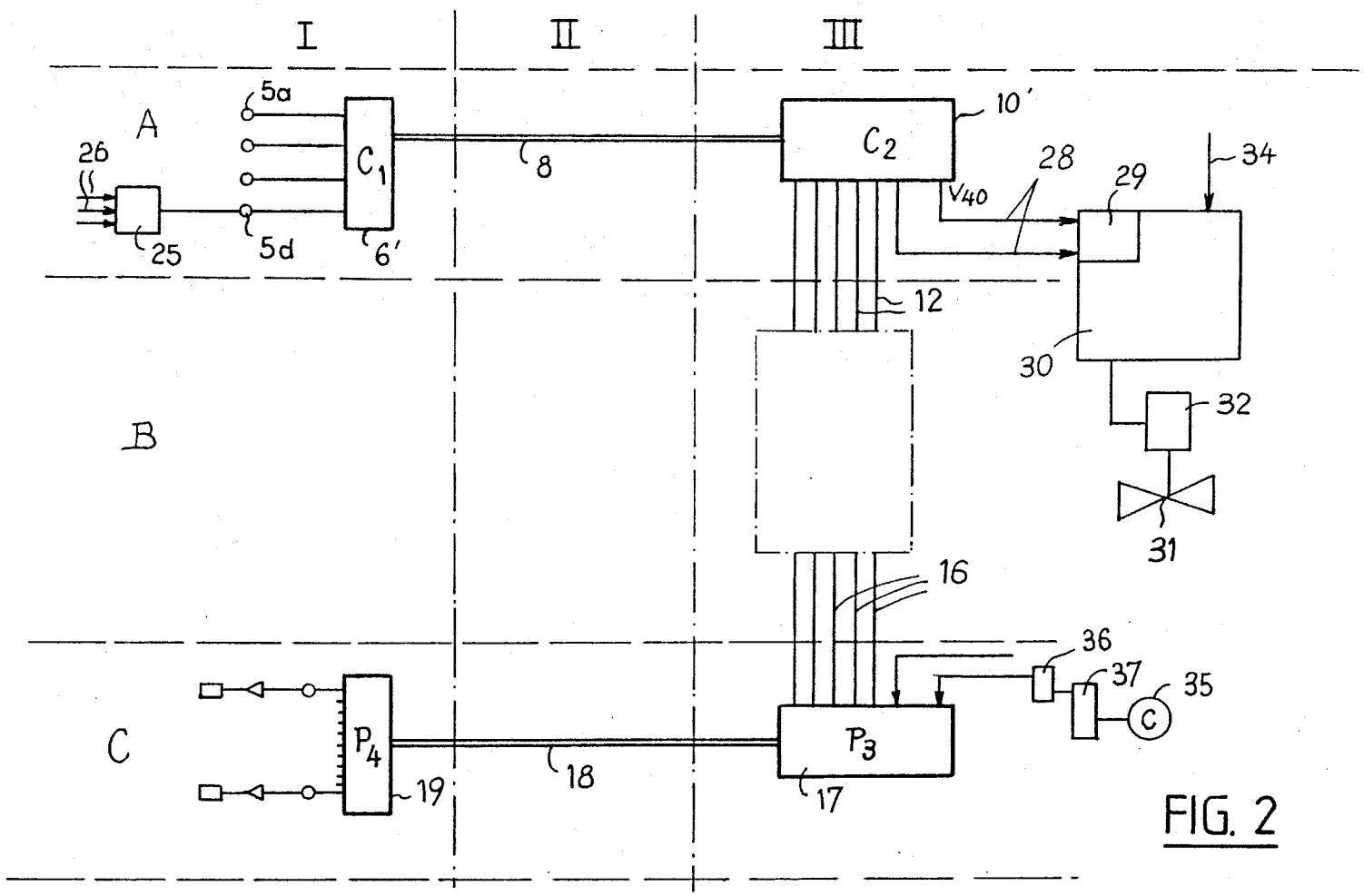
FIG. 2 is a schematic view of a device for transmission of informatoin and of orders between the control room and the active part of the power station, where the device meakes use of couplers and polychromators.

In FIG. 2, the component which are identical with those represented in FIG. 1 have been given the same reference numerals. The optical sources 5*a* to 5*d* are connected with a coupler 6', which permits transmission of the rays emitted by these sources into a fiber 8, which is itself connected at its other end to a second coupler 10'. The couplers 6' and 10' perform functions which are identical with those of the polychromators 6 and 10 of FIG. 1, with regard to the generation of the rays supplying the sensors, these rays nevertheless exhibiting broad band spectra as in the case of the radiation transmitted by the fiber 8.

In the same way, the transmission of the information between the active zone of the power station and the control room in ensured by virtue of a polychromator 17, an optical fiber 18 and a polychromator 19 providing for multiplexing, transmission and demultiplexing of the information, respectively. The information supplied by the sensors connected to the measurement channels at the output of the coupler 10' is transmitted and processed within the zone C of the apparatus, as has been described with reference to FIG. 1. In particular, the rays transmitted have a narrow spectrum centered on a wavelength representative of the emission sensor.

In addition to its function of measurement and of control in relation to the installation, the apparatus represented in FIG. 2 permits transmission of orders to certain motorized components of this installation which are disposed in its active zone.

In order to achieve this, a modulator 25 is connected to the source 5*d* so as to permit modulation of its radiation, as a function of the commands transmitted by the command elements 26 to the modulator 25. The radiation originating from the source 5d is transmitted to the coupler 10' by the optical fiber 8 and divided into unitary radiations which are transmitted into optical fibers 28 connected to the power equipment of a component of the industrial installation which is provided with an actuator. FIG. 2 shows a channel 28 connected to an opti-electronic converter 29 associated with the command equipment 30 of a motor-driven vane 31. The motor 32 of this vane is controlled by virtue of the optical signals transmitted by the fiber 28 to the converter 29 and converted into electrical command signals. These optical command signals at the output of the decoupler 10' originate from orders transmitted by the command elements 26 to the modulator 25. Each actuator having a specific address means takes into account only the signals which are intended for it.

In addition to the thirty measurement channels as represented and described with reference to FIG. 1, it is possible to make use of ten command channels permitting the issue of commands to an equivalent number of active components of the industrial installation.

The giving of commands to these components necessitates, in any event, an electrical power supply 34 to supply the motor such as 32 through the electrical command equipment 30. Although the object of the invention is to transmit the information and the orders by optical means, the process permits the transmission of the information from conventional electrical sensors.

Provision has likewise been made, on the apparatus represented in FIG. 2, for the possibility of introducing information into the multiplexing polychromator 17, this information originating from conventional electrical sensors such as 35 connected to an electro-optical interface 36 throuh a transmitter 37. At the output of the electro-optical interface 36, the electrical signals from the sensor 35 have been converted into optical signals, which are transmitted to the command position through the optical fiber 18.

Figure 3:
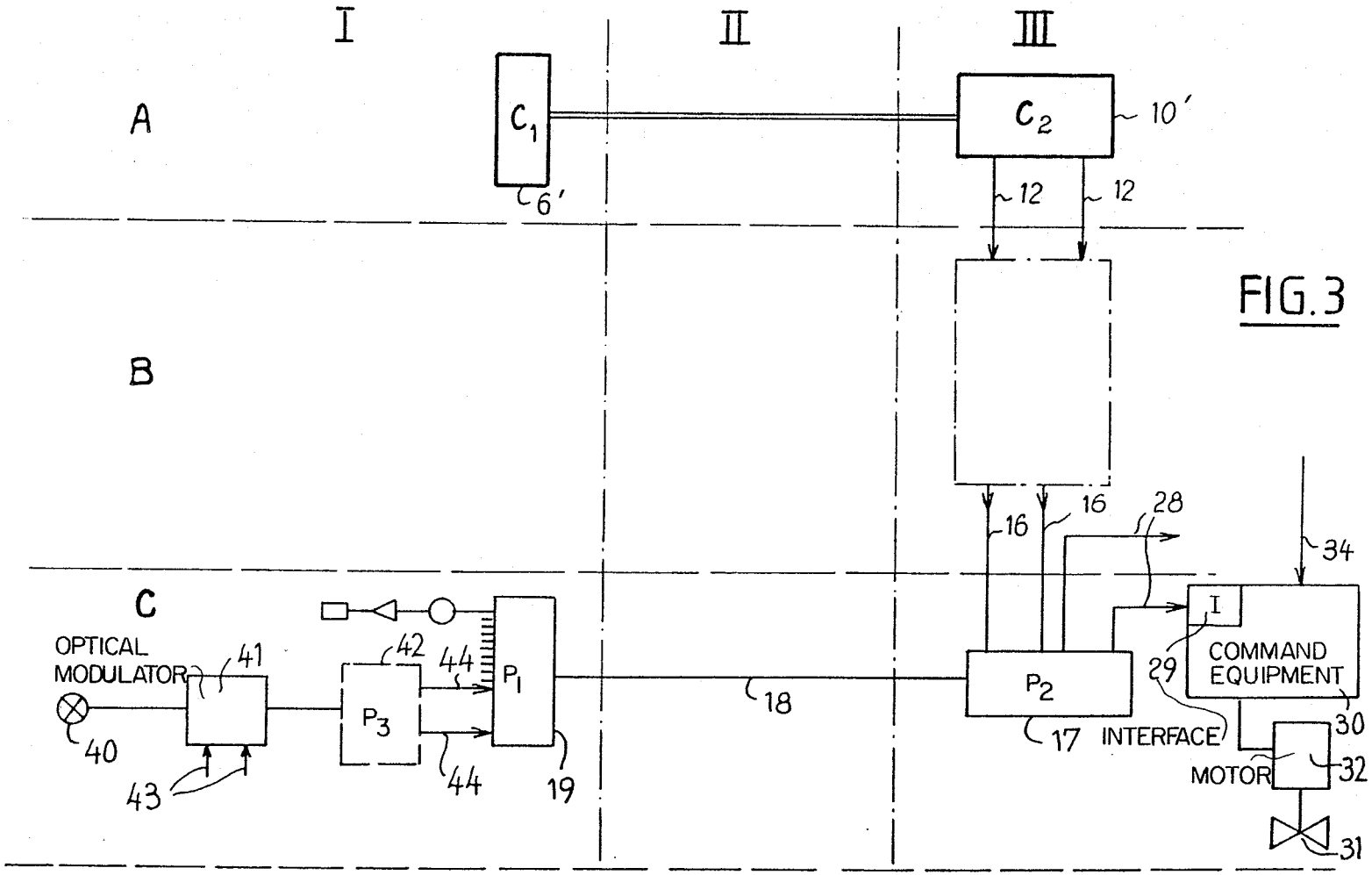
FIG. 3 is a schematic representation of a modified embodiment of the device for transmission of information and of orders represented in FIG. 2.

FIG. 3 shows a modified embodiment of the appartus for transmisison of information and of orders shown in FIG. 2, the orders being transmitted between the control room and the active zone of the apparatus through the polychromator 19, the fiber 18 and the polychromator 17. The orders are transmitted with the use of a light source 40, a modulator 41 and a polychromator 42, this assembly permitting, by virtue of command components 43, the transmission of orders through a plrualit of optical fibers 44 connecting the output of the polychromator 42 to the polychromator 19.

The orders at the output of the polychromator 17 are transmitted, as previously, to opto-electronic convertors such as 29, which are associated with command equipement such as 30, which is associated with a component such as 31, which is, in the present instance a motordriven vane incorporating an actuating motor 32. As previously, the entire assembly is supplied with electrical power current by a supply 34.

In this embodiment, use has accordingly been made of the polychromators and of the optical fiber for transmission of the information, in order to cause the orders from the control room to reach the active zone of the power station.

Figure 4:
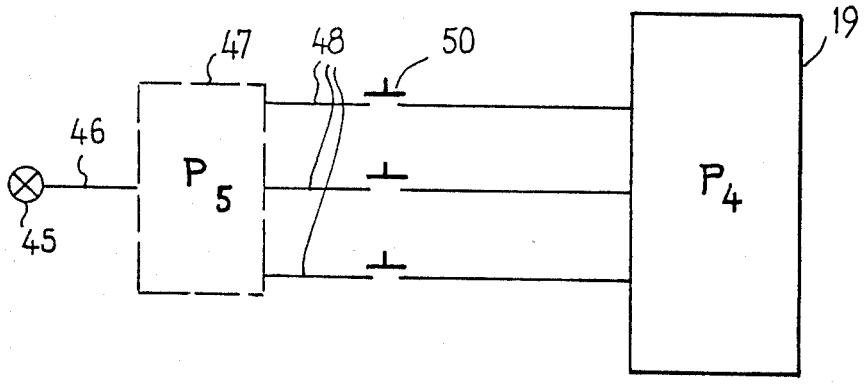
FIG. 4 shows a modified embodiment of the means for transmission of orders of the device represented in FIG. 3.

By way of a varient, FIG. 4 shows an apparatus for the transmission of orders to the polychromator 19 of FIG. 3 constituted by an optical source 45 connected by an optical fiber 46 to a polychromator 47 comprising a pluality of output channels 48 constituted by optical fibers. On each one of the channels 48 there is disposed a command component 50 permitting an order to be sent to the corresponding equipment through the polychromator 19, the fiber 18 and the polychromator 17.

Figure 5:
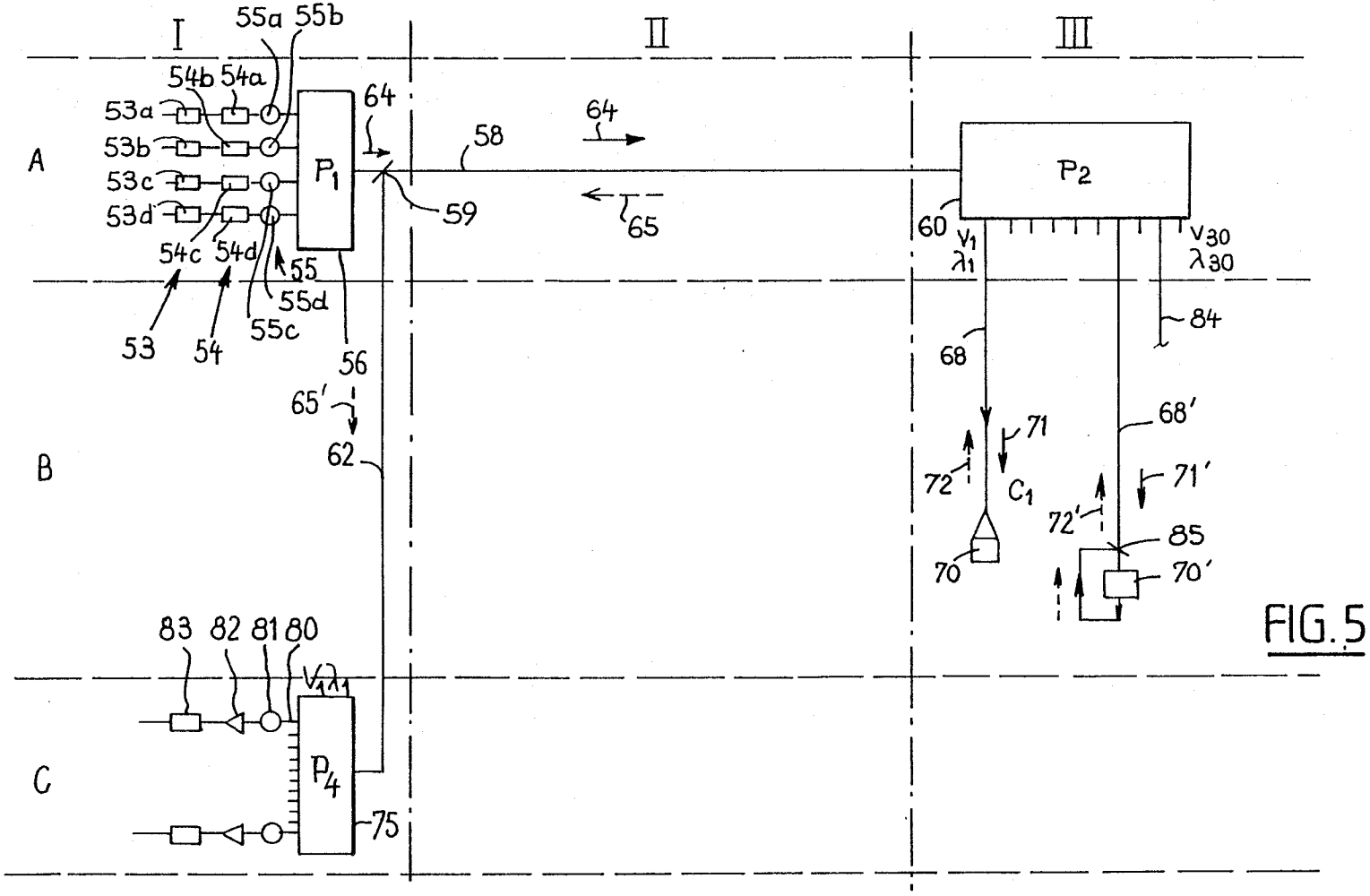
FIG. 5 is a schematic view of a modifed embodiment of a device for transmission of information and of orders making use of a single optical fiber for feeding the sensors and for collecting the information.

In FIG. 5, the functional zone A comprises, within the control room I, four oscillators 53*a*, 53*b*, 53*c* and 53*d* and four regulators 54*a*, 54*b*, 54*c* and 54*d* permitting the establishment of optical sources 55*a*, 55*b*, 55*c* and 55*d*, respectively. The regulators 54 permit assurance of the stability of the luminous sources 55, which are generated by the devices 53 and 54 in such a manner as to obtain, by coupling of the radiations which they produce, a radiation having a broad spectral band. This coupling of the sources 55*a* to 55*d* is obtained by virtue of a polychromator 56 which may be of the multidelectric type described in French Pat. No. 2.530.393 or of the network type as described in French Pats. Nos. 2.479.981 and 2.543.768.

At the output of the polychromator 56, there is located the input end of an optical fiber 58 which collects the radiation having a broad spectral band obtained by coupling of the source 55 within the polychromator 56.

The optical fiber 58 of great length permits transmission of the radiation having a broad spectral band between the control room of the reactor I and the active zone of the power station constituted, for example, by the building of the reactor III, through the zone II.

A coupler 59 is inserted into the path of the fiber 58, within the control room, slightly behind the output of the polychromator 56. This coupler is, by way of example, of the type described in French Pat. No. 2.536.545, i.e., a Y coupler that is to say a Y coupler.

One of the inlet ends of a second optical fiber 62 is located at one of the outputs of the coupler 59. The radiation emerging from the polychromator 56 is separated into two fluxes of equal luminous intensity. The first of these fluxes is propagated in the fiber 58 according to the arrow 64 shown in solid lines, i.e., in the direction proceeding from the control room I to the active zone III. The second is directed according to a direction orthogonal to the fiber 58, and is not used in this application.

In the opposite direction, the radiation reflected, after modulation in the sensors 70, by the poly chromator 60, after modulation in the sensors 70, is propagated in the fiber 58 according to the arrow shown in broken lines 65c, i.e., in the direction proceeding from the active zone III to the control room I. This radiation is likewise divided into two fluxes of equal intensity within the coupler 59. The first of these fluxes returns towards the source represented by the polychromator 56, without any effect thereon. The second flux is directed in a direction orthogonal to the fiber 58, proceeding in the direction of the arrow shown in broken lines 65', towards the polychromator 75.

At its end remote from the coupler 59, the optical fiber 58 is connected to a polychromator 60, which thus receives as input the radiation having a broad spectral band originating from the sources 55. This polychromator 60 permits division of the radiation having a broad spectral band into a plurality of unitary radiations which are entirely distinct according to their wavelength, the division within the polychromator 60 permitting generation of radiations having a small spectral width centered about a precise wavelength.

Forty unitary luminous radiations are thus produced at the output of the polychromator 60 and directed within forty optical fibers 68 each of which is connected to a sensor 70.

The assembly constituted by the polychromator 60, the fibers 68 and the sensors 70 is situated within the active zone III of the nuclear power station.

The sensors 70 may be of different types. By way of example, the sensors 70 are of the retroreflection type, i.e., that they permit reflection within the fiber 68, in the direction of the arrow shown in broken lines 72, of the modulated radiation obtained from the incident radiation directed within the fiber 68 in the direction given by the arrow 71 in solid lines. Another example is given by the sensors 70' which are of the single passage type and comprise, in association with the exterior of the sensors or with the interior of the latter, a coupler device 85 which permits the return of the light, after modulation within the sensor 70', in the fiber 68' and in the direction of the arrow shown in broken lines 72'.

At the output of the polychromator 60, each unitary radiation characterized by its wavelength corresponding to a sensor 70 is directed by the corresponding optical fiber 68 to this sensor, is modulated by the sensor as a function of the conditions in which the sensor is found, and is then returned by the optical fiber 68 to the polychromator 60. The polychromator 60 provides for the multiplexing of the luminous radiations bearing information coming from the sensors 70 and introduction thereof into the optical fiber 58, which permits transmission thereof in the direction of the arrow 65 to the coupler 59 which effects extraction thereof by the fiber 62.

The luminous radiations carrying the information from the sensors 70 are directed into a polychromator 75, which effects the demultiplexing of the information carried by these luminous radiations.

At the output of the polychromator 75, the forty radiations carrying the information from the forty sensors 70 are collected by virtue of optical fibers 80 and transmitted to processing devices, each one of which comprises an opto-electronic converter 81, an amplifier 82 and a preprocessing module 83.

At the output of the opto-electronic converter 81, the optical signals carrying information have been converted into electrical signals, which are processed in the traditional manner by the amplifier 82 and the module 83. It is possible, for example, to carry out within the modules 83 preliminary processing operations such as the comparison of the signals with predetermined threshold values, the comparison of the signals among themselves or the monitoring of their developement over time.

Certain channels corresponding to optical fibers 68 within the active zone of the power station serve for the permanent monitoring of the condition of the components of the optical transmission apparatus. This applies to the channel 84, which permits testing of the parts of the apparatus relating to the generation of the sources, the acquisition of the information and the multiplexing and demultiplexing of this information.

It is seen that the advantages of the process and of the apparatus according to the invention are the enabling of the transmission of information and of orders between a control position and an active zone of an industrial installation situated at a large distance from the control position, entirely by optical means, without the use of any source of energy or of electrical command signals within the active zone of the installation. Moreover, the process likewise permits the transmission by optical means of the information originating from conventional electrical signal sensors. In this manner, a very great reduction of the risks is achieved in circumstances in which it is necessary to process substances or media which are inflammable or explosive. Another result is an operation which is extremely reliable and which does not necessitate any intervention within the active zone; this is of particular benefit in the case of nuclear reactors. The control of the operation of the various parts of the apparatus for transmission of information and of orders by optical means may be undertaken simultaneously for all the means which are utilized, although in the case of electrical commands it is necessary to use sequential tests on the various components.

Moreover, the apparatus for transmission with the use of optical fibers permits a reduction in the volume of the transmission lines which are used, as a result of the multiplexing and demultiplexing.

The measures and the orders relating to the various parts of the installation are completely differentiated, by virtue of the allocation of different wavelengths to each one of the measurement or order transmission channels.

The embodiment shown in FIG. 5 presents the additional advantage of using a single optical fiber having a great length and connecting the control position to the active zone of the installation; this single fiber thus ensures the supply of the sensors as far as the collecting of the information. The polychromator located in the active zone ensures equally two functions: the division of the luminous radiation and the multiplexing of the information. Thus the number of necessary components is reduced.

It is possible to contemplate other means for achieving the generation of the sources or the multiplexing and the demultiplexing of the information, it being possible the polychromators and couplers which have been described to be replaced by equivalent devices.

It is likewise possible to contemplate the idea of associating with the apparatus for the transmission of information and of orders by optical means, certain parts processing electrical signals. Such an association may be effected by means of opto-electronic converters or other interfaces providing for conversion of the optical signals into electrical signals, or conversely of electrical signals into optical signals.

Finally, the process and the apparatus according to the invention are not only applicable to nuclear power stations which include a pressurized water reactor, but likewise in other sectors of the nuclear industry, to pertroleum and petro-chemical installations, to chemical installations in general, to mining installations, to steel making plants, to submarine activities or indeed in the sector of powders and explosives. In a general way, the process and apparatus according to the invention are applicable within the context of numerous industrial installatoins implementing a continuous process, a semi-continuous process or a discontinuous process. It is likewise possible to envisage its application in sectors where the gain in weight, albeit limited, is very significant, and more particulary in the area of air transport and space vehicles.

We claim:

1. Apparatus for the control and supervision of an industrial installation by transmission of information and of orders by optical means between an active zone (III) including an active part of said industrial installation and a control position (I) separate from said active part, said apparatus comprising:

(a) within said control position (I), means for establishing at least one stable optical source, an optical coupling device an input of which receives the radiation from said optical source and an output of which is connected to one end of a first optical fiber and a first polychromator the outputs of which are connectd to an assembly for the processing of information; and (b) within said active zone (III) a device for the division of optical radiation, an input of which is connected to a second end of said first optical fiber, an assembly of sensors associated with said active part (III), each of said sensors being connected to an output of said device by an optical fiber and to a second polychromator by an optical fiber, said second polychromator being connected at its output to one end of a second optical fiber the other end of which is connected to the input of said first polychromator, said first and second fibers joining said control position (I) to said active zone (III), wherein are further provided:

means for the transmission of orders in the form of luminous radiations to the first polychromator, within the control position (I), the orders in the form of luminous radiations being transmitted through the first polychromator and the second fiber to the second polychromator within the active zone (III), and a device for the command of at least one component within the active zone (III) of the installation, associated with an opto-electronic converter receiving the light rays representing the orders at the output of the second polychromator.

2. Apparatus for control and supervision according to claim 1, wherein the means for the transmission of orders in the form of luminous radiations are constituted by a source, a modulator and at least one command component, the output of the modulator being connected by an optical fiber to the input of a third polychromator connected by at least one optical fiber to at least one of the inputs of the first polychromator.

3. Apparatus for control and supervision according to claim 1, wherein the means for the transmission of orders in the form of luminous radiations are constituted by a light source connected by a fiber to the input of an intermediate polychromator, on each one of the outputs of which a command component is disposed, each of one of the outputs of the intermediate polychromator constituted by an optical fiber being connected to one of the inputs of the first polychromator.

* * * * *

UNITED STATES PATENT AND TRADEMARK OFFICE

CERTIFICATE OF CORRECTION

PATENT NO. : 4,817,202

DATED : MARCH 28, 1989

INVENTOR(S) : MEYER ET AL.

It is certified that error appears in the above-identified patent and that said Letters Patent is hereby corrected as shown below:

Title page:

The name of the third inventor should read:

--Jean-Pierre LAUDE--

Signed and Sealed this

Sixteenth Day of October, 1990

*Attest:*

HARRY F. MANBECK, JR.

*Attesting Officer*

*Commissioner of Patents and Trademarks*